US007251428B2

(12) United States Patent
Yoshimura et al.

(10) Patent No.: US 7,251,428 B2
(45) Date of Patent: Jul. 31, 2007

(54) IMAGE FORMING APPARATUS WITH HEATING ROTATABLE MEMBER AND RESET CONTROL MEANS FOR INTERRUPTING A CURRENTLY EXECUTING IMAGE FORMATION JOB

(75) Inventors: Yasuhiro Yoshimura, Ryugasaki (JP); Toshiharu Kondo, Moriya (JP); Naoyuki Yamamoto, Toride (JP); Takahiro Nakase, Toride (JP); Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,799

(22) Filed: Oct. 21, 2005

(65) Prior Publication Data

US 2006/0088328 A1 Apr. 27, 2006

(30) Foreign Application Priority Data

Oct. 22, 2004 (JP) ..... 2004-308792

(51) Int. Cl.
*G03G 15/20* (2006.01)

(52) U.S. Cl. ..... 399/69; 399/328; 219/619

(58) Field of Classification Search ..... 399/69, 399/328; 219/619

See application file for complete search history.

(56) References Cited

U.S. PATENT DOCUMENTS

| | | | | |
|---|---|---|---|---|
| 6,219,522 | B1 | 4/2001 | Ishizuka et al. | 399/333 |
| 6,240,263 | B1 | 5/2001 | Watanabe et al. | 399/69 |
| 6,970,664 | B2 | 11/2005 | Yamamoto | 399/69 |
| 7,098,430 | B2 | 8/2006 | Kondo et al. | 219/619 |
| 7,122,769 | B2 | 10/2006 | Nami et al. | 219/619 |
| 7,132,631 | B2 | 11/2006 | Nami et al. | 219/619 |
| 2002/0116144 | A1 | 8/2002 | Yamauchi et al. | 702/132 |
| 2003/0077093 | A1* | 4/2003 | Sekiguchi | 399/328 |
| 2004/0228644 | A1* | 11/2004 | Kikuchi | 399/69 |
| 2005/0173415 | A1 | 8/2005 | Yamamoto et al. | 219/619 |
| 2005/0252912 | A1 | 11/2005 | Yamamoto | 219/619 |
| 2006/0086719 | A1 | 4/2006 | Suzuki et al. | 219/619 |
| 2006/0086720 | A1 | 4/2006 | Nakase et al. | 219/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0088328 | A1 | 4/2006 | Yoshimura et al. | 399/69 |
| 2006/0088329 | A1 | 4/2006 | Suzuki et al. | 399/69 |

FOREIGN PATENT DOCUMENTS

| | | |
|---|---|---|
| JP | 59-33787 | 2/1984 |
| JP | 2000-162913 | 6/2000 |
| JP | 2001337555 A * | 12/2001 |
| JP | 2002-174981 | 6/2002 |
| JP | 2003-107973 | 4/2003 |
| JP | 2003-123957 | 4/2003 |

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

An image forming apparatus has an image forming unit; a heating rotatable member; a magnetic flux generator for generating a magnetic flux for induction heat generation in the heating rotatable member; a controller for controlling a temperature of the heating rotatable member; a temperature detector for detecting a temperature of the heating rotatable member at a predetermined region; magnetic flux confinor for confining the magnetic flux from the magnetic flux generator in accordance with an output of the temperature detector; and a moving unit for movement the magnetic flux confinor between a magnetic-flux-confinement position and a n on-magnetic-flux-confinement position, wherein when the output of the temperature detector indicates a temperature outside a predetermined temperature range, an image forming operation is interrupted, and executes operation of the moving unit to move the magnetic flux confinor to the non-magnetic-flux-confinement position and restoring operation to restore the temperature of the heating rotatable member.

6 Claims, 7 Drawing Sheets

IMAGE FORMING APPARATUS WITH HEATING ROTATABLE MEMBER AND RESET CONTROL MEANS FOR INTERRUPTING A CURRENTLY EXECUTING IMAGE FORMATION JOB

FIELD OF THE INVENTION AND RELATED ART

The present invention relates to an image forming apparatus for forming an image on recording medium with the use of an electrophotographic or electrostatic image forming method, or the like. As examples of such an image forming apparatus, a copying machine, a printer, a facsimileing machine, and a multifunction apparatus having two or more functions of the preceding image forming apparatuses.

An electrophotographic copying machine or the like is provided with a fixing apparatus for fixing an unfixed toner image (image formed of toner) having been transferred onto a sheet of recording medium.

For the purpose of reducing such a fixing apparatus in energy consumption (electric power consumption), a fixing apparatus, which employs, as a heat source, a heating means which uses high frequency waves to heat the heating member of the fixing apparatus by electromagnetic induction, has been proposed (for example, Japanese Laid-open Patent Application 59-33787).

This fixing apparatus employing a heating method based on electromagnetic induction (which hereinafter will be referred to simply as induction-based fixing apparatus) is made up of a hollow fixation roller formed of an electrically conductive metallic substance, and a coil disposed in the hollow of the fixation roller so that it becomes concentric with the fixation roller. As for the method for heating the fixation roller, eddy current is induced in the wall of the fixation roller by the high frequency magnetic field generated by flowing high frequency electric current through the coil, so that heat (Joule heat) is directly generated in the wall of the fixation roller through the interaction between this eddy current and the surface resistance of the fixation roller itself. In other words, heat is directly generated in the wall of the fixation roller itself of the fixing apparatus, and therefore, the fixing apparatus is high in energy efficiency.

A fixing apparatus such as the above described one is problematic in that when an image is formed using a sheet of recording medium, the size of which is smaller than the size of the largest sheet of recording medium usable with the fixing apparatus, the lengthwise end portions of its fixation roller, that is, the portions of the fixation roller outside the path of the sheet of recording medium in terms of the lengthwise direction of the fixation roller (width direction of sheet of recording medium), excessively rise in temperature as the image forming operation continues, and this excessive rise in temperature of the fixation roller sometimes thermally deteriorates the fixation roller.

Japanese Laid-open Patent Application 2003-123957 discloses a fixing apparatus designed to deal with this problem. In order to prevent its fixation roller from excessively rising in temperature, this fixing apparatus is provided with a magnetic flux blocking plate, which is movable to one of the specific positions in the gap between its coil and the fixation roller, in order to block the portions of the magnetic flux directed toward the fixation roller from the coil.

However, even a fixing apparatus such as the above described one, which is provided with a magnetic flux blocking plate, has been problematic in that while copies are made using sheets of recording medium, which are smaller in size than the largest sheet of recording medium usable with the image forming apparatus (fixing apparatus), the portions of the fixation roller outside the recording medium path excessively rise or fall in temperature.

The above described problem seems to occur because of such an error that in spite of the fact that a signal for moving the magnetic flux blocking plate has been sent from the control apparatus to the mechanism for driving the magnetic flux blocking plate, the magnetic flux blocking plate has not been moved at all, or has not been moved into the proper position. Moreover, it is possible to surmise that the state of contact between the thermistor of the contact type for detecting the temperature level of the portion of the fixation roller outside the recording medium path, and the fixation roller, has deteriorated. It is also possible to surmise that the above described problem will occur due to such an error that an extremely thick or thin sheet of recording medium (sheet of recording medium which is too high or too low in thermal capacity), that is, a sheet of recording medium, which is too thick or thin to meet the specifications of the image forming apparatus regarding the thickness of the recording medium usable with the apparatus is used as the recording medium.

When the fixation roller excessively rises or falls in temperature across its lengthwise portions outside the recording medium path as described above, it is possible to call a service person to deal with the problem. However, as long as the on-going image forming operation is interrupted as soon as the excessive temperature increase or decrease occurs, it may not be necessary to call a service person, although it depends on the cause or causes of this temperature anomaly. Of course, it is possible to surmise that the process of moving the magnetic flux blocking plate happens to be temporarily interrupted for some reason, and the process will soon be resumed.

Therefore, it is not a good idea to stop the on-going image forming operation as soon as the fixation roller becomes abnormal in temperature across its lengthwise portions outside the recording medium path.

SUMMARY OF THE INVENTION

The primary object of the present invention is to provide an image forming apparatus capable of automatically recovering from the problem that the temperature of its rotatable heating member temporarily falls out of the preset temperature range, across the predetermined portions thereof.

According to an aspect of the present invention, there is provided an image forming apparatus comprising image forming means for forming an image on a recording material; a heating rotatable member; magnetic flux generating means for generating a magnetic flux for induction heat generation in said heating rotatable member; control means for controlling a temperature of said heating rotatable member, temperature detecting means for detecting a temperature of said heating rotatable member at a predetermined region; magnetic flux confining means for confining the magnetic flux directed toward the predetermined region of said heating rotatable member from said magnetic flux generating means in accordance with an output of said temperature detecting means; and moving means for movement said magnetic flux confining means between a magnetic-flux-confinement position and a non-magnetic-flux confinement position, wherein when the output of said temperature detecting means indicates a temperature outside a predetermined temperature range, an image forming operation is interrupted, and executes operation of said moving means to move said magnetic flux confining means to the non-magnetic-flux-confinement position and restoring operation to restore the temperature of said heating rotatable member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. The measurements, materials, and shapes of the structural components, and the positional relationship among them, in the following embodiments of the present invention, are not intended to limit the scope of the present invention, unless specifically noted.

Embodiment 1

First, referring to FIGS. 1-4, and 6, the fixing apparatus and image forming apparatus equipped with the fixing apparatus, in the first embodiment of the present invention, will be described.

<Structures of Fixing Apparatus and Image Forming Apparatus>

Figure 1:
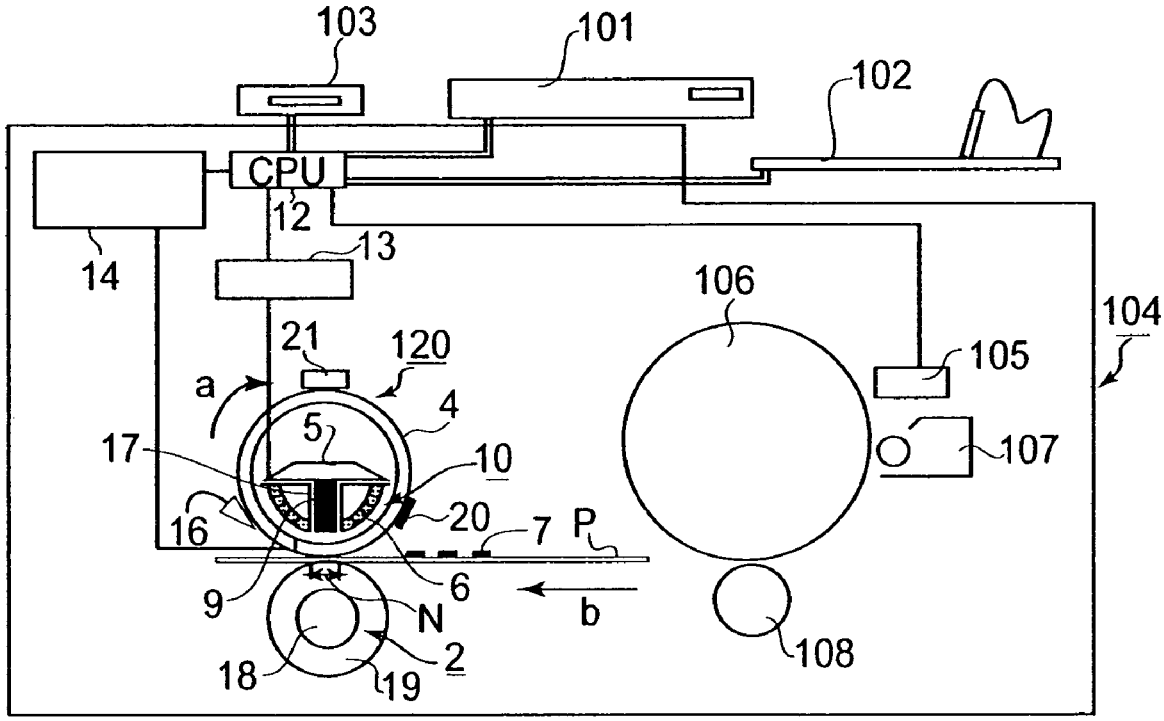
FIG. 1 is a schematic sectional view of the image forming apparatus in the preferred embodiment of the present invention, showing the general structure thereof.
Figure 2:
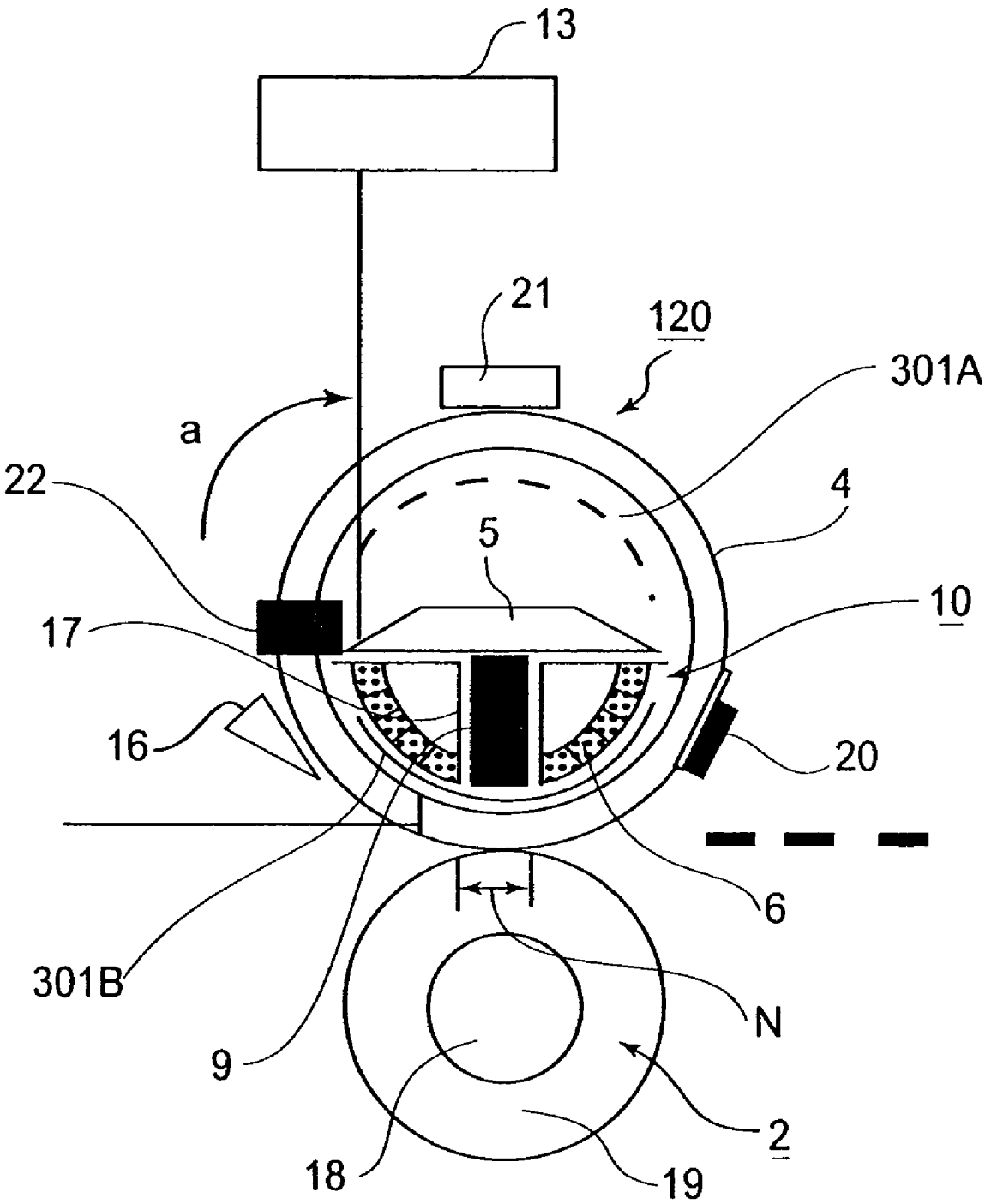
FIG. 2 is a schematic sectional view of the fixing apparatus in the preferred embodiment of the present invention.
Figure 3:
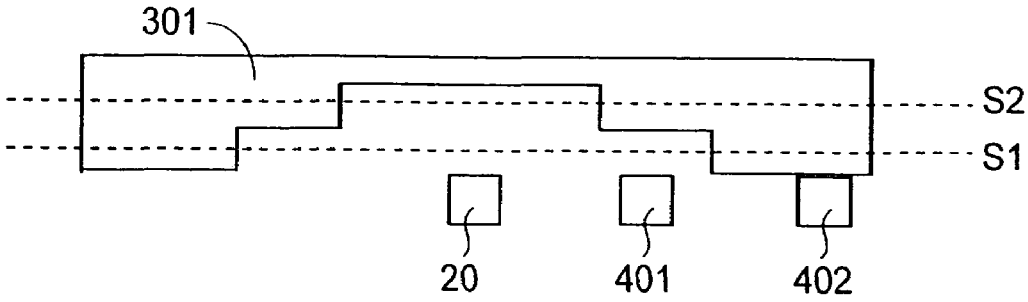
FIG. 3 is a schematic drawing showing the positional relationship between the magnetic flux blocking plate as a magnetic field blocking member, and temperature sensors as temperature detecting means, with which the fixing apparatus in the first embodiment of the present invention is provided.

First, referring to FIGS. 1-3, the fixing apparatus in this embodiment, and an image forming apparatus equipped with the fixing apparatus, will be described regarding their structures. FIG. 1 is a schematic sectional view of the image forming apparatus equipped with the fixing apparatus in this embodiment of the present invention, showing the general structure thereof. FIG. 2 is a schematic sectional view of the fixing apparatus in this embodiment of the present invention. FIG. 3 is a schematic drawing showing the positional relationship between the magnetic field blocking plate as a magnetic field blocking member, and the temperature sensors as temperature detecting means, with which the fixing apparatus in this embodiment of the present invention is provided.

Referring to FIG. 1, the image forming apparatus in this embodiment of the present invention is provided with an original reading apparatus 101 having the function of reading the image of an original mounted on an original placement platen. This original reading apparatus 101 scans the original on the original placement platen, with a beam of light projected from the optical system (unshown) for illuminating and scanning an original, which is made up of a light source and disposed within the main assembly of the image forming apparatus, and reads the light reflected by the original, with an optical sensor (unshown) such as a CCD line sensor or the like; it converts the light reflected by the original (optical signals) into electrical signals.

Designated by a referential symbol 102 is an area marking apparatus (digitizer), which marks the area of the original to be read, and outputs signals. Designated by a referential symbol 103 is a printer controller, which outputs print signals according to the image formation data inputted from a personal computer or the like (unshown). Designated by a referential symbol 104 is the image outputting apparatus which forms an image in response to the signals inputted thereto from the original reading apparatus 101 through the digitizer 102 and printer controller 103. This image outputting apparatus 104 is provided with such image forming means as an image writing apparatus 105, a developing apparatus 107, and a transferring apparatus 108, and a fixing apparatus 120 employing one of the heating methods based on electromagnetic induction.

Designated by a referential symbol 12 is a controlling means (CPU) which processes signals to send commands to various portions of the image forming apparatus, and carries out various control functions, in response to the signals it receives from the original reading apparatus 101 and digitizer 102. Designated by a referential symbol 105 is the image writing apparatus comprising a laser, for example, which writes (forms) an electrostatic latent image on a photosensitive drum 106, in response to the signals generated by the CPU 12 according to the image formation data. It is an image writing apparatus employing a laser, for example. After being formed on the peripheral surface of the photosensitive drum 106, the electrostatic latent image is visualized as an image formed of toner (toner image) by the developing apparatus 107. Then, the toner image (unfixed image) is transferred by the transferring apparatus 108 onto a sheet P of recording medium delivered from a sheet feeding/conveying means (unshown).

After the transfer of the unfixed toner image onto the sheet P, the sheet P is conveyed to the fixing apparatus 120, in which the sheet P is sent (in the direction indicated by arrow mark b in FIG. 1) into the nip N between the fixation roller 4 as a rotatable heating member, and the pressure roller 2 as a rotatable pressure applying member. Then, the sheet P is conveyed through the nip N while being subjected to the heat from the heated fixation roller 4 and the pressure from the pressure roller 2.

As a result, the unfixed toner image is fixed to the surface of the sheet P; a fixed toner image is formed on the surface of the sheet P.

After being conveyed through the nip N, the sheet P is peeled away from the fixation roller 4 by a separation claw 16, the tip of which is in contact with the peripheral surface of the fixation roller 4, and then, is conveyed in the leftward direction of FIG. 1. Thereafter, the sheet P is further conveyed, and discharged by a pair of unshown sheet discharge rollers onto the delivery tray.

Next, the fixing apparatus 120 will be described in more detail. The fixing apparatus 120 in this embodiment is an apparatus for fixing the unfixed toner image on the sheet P by thermally welding the toner particles 7, of which the unfixed image is formed on the sheet P, to the surface of the sheet P while the sheet P is conveyed.

The fixing apparatus 120 is provided with a coil assembly 10, which generates a high frequency magnetic field. The coil assembly 10 is provided with an excitation coil 6 as a magnetic flux generating means. The fixing apparatus 120 is also provided with the fixation roller 4, which is electromagnetically heated by the coil assembly 10. The fixation roller 4 is rotatably disposed so that it can be rotated in the direction to convey the sheet P in the predetermined direction. Further, the fixing apparatus 120 is provided with a pressure roller 2, which is kept pressed upon the fixation roller 4 so that the sheet P can be conveyed between the fixation roller 4 and pressure roller 2.

Figure 4:
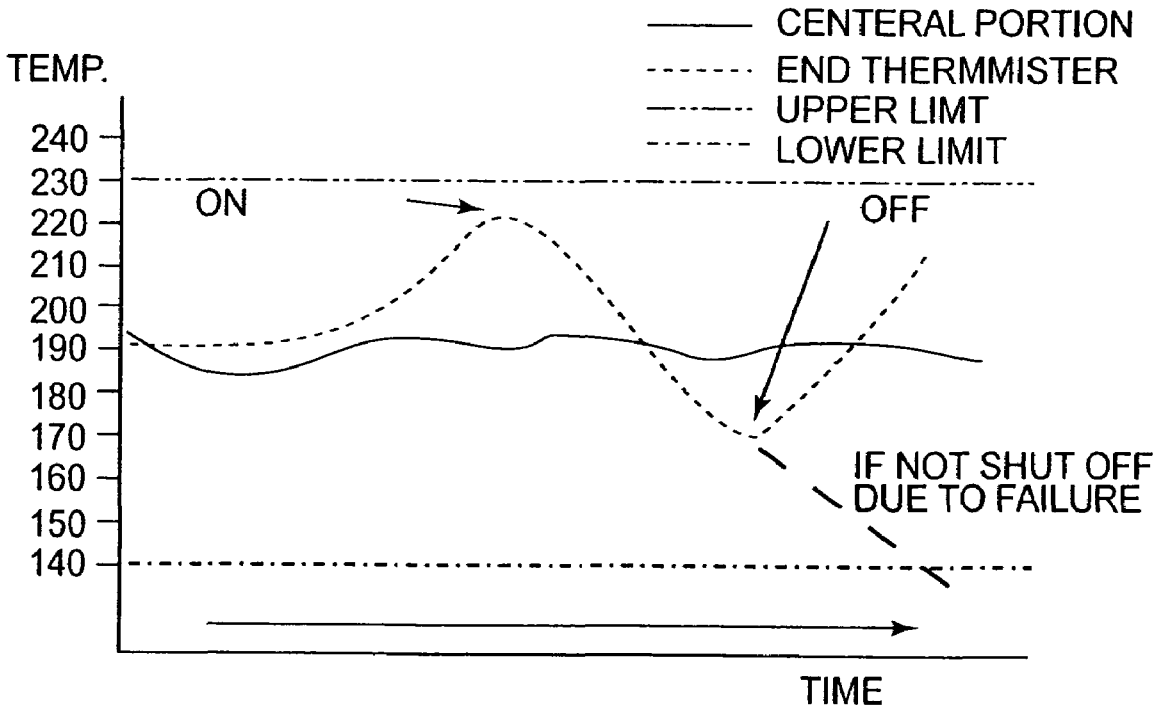
FIG. 4 is a graph showing the changes in the temperatures of the fixation roller, which occurred as sheets of recording medium, the sizes of which were smaller than that of the largest sheet of recording medium usable with the image forming apparatus (fixing apparatus), were conveyed through the fixing apparatus.

The fixation roller 4 is rotatably disposed so that it can be rotated in the direction indicated by an arrow mark a in FIG. 4. It is rotationally driven by a driving circuit portion, with the use of an unshown motor or the like. As for the pressure roller 2, it is rotated by the rotation of the fixation roller 4. Designated in the drawing by a referential symbol 13 is an electric power source for supplying the coil assembly 10 with the high frequency electric current for driving the coil assembly 10, in response to the signals sent from the CPU 12.

The abovementioned fixation roller 4 is in the form of a hollow cylinder, and is provided with an electrically conductive layer formed of an electrically conductive metallic substance, for example, iron, nickel, SUS 430, or the like. The surface layer of the fixation roller 4 is a heat resistant toner releasing layer formed by coating a fluorinated resin or the like on the peripheral surface of the metallic layer of the fixation roller 4. The thickness of the metallic layer of the fixation roller 4 is in the range of 0.1 mm-1.5 mm.

In the hollow of the fixation roller 4, the coil assembly 10 for generating the high frequency magnetic field is disposed to generate heat (Joule heat) in the metallic layer of the fixation roller 4 by inducing electric current (eddy current) in the metallic layer. The coil assembly 10 is held by a stay 5 so that a preset amount of gap is maintained between the fixation roller 4 and excitation coil 6. The stay 5 is rigidly attached to the unshown frame of the fixation unit, and is structured so that it does not rotate. It is formed of an electrically insulative substance.

The coil assembly 10 is made up of a core 9 formed of a magnetic substance, and a bobbin 17 having a hole in which the core 9 is inserted. The excitation coil 6, which is for generating heat in the wall of the fixation roller 4 by inducing electric current in the wall of the fixation roller 4, is formed of multiple strands of copper wire and is wound around this bobbin 17.

In this embodiment, high frequency electric current, the frequency of which is in the range of 20 kHz-100 kHz, is supplied, as inductive current, to the excitation coil 6. The multiple strands of copper wire, of which the excitation coil 6 in this embodiment is formed, is in the form of Litz wire. As the material for the sheathing for the copper wire, the usage of a highly heat resistant substance is desired. In this embodiment, polyimide is used as the sheathing material for the copper wire, and therefore, the highest temperature level which the coil 6 withstands is 230° C. As the material for the core 9, a substance which is high in magnetic permeability and low in internal loss is suitable, for example, ferrite, Permalloy, Sendust, or the like. The bobbin 17 functions as the portion for insulating between the core 9 and excitation coil 6. The coil assembly 10 is rigidly attached to the abovementioned stay 5 so that it is not exposed from the fixation roller 4. The stay 5 is separately formed from the bobbin 17.

The stay 5, separation claw 16, and bobbin 17 are formed of an engineering plastic which is heat resistant and electrically insulative.

The pressure roller 2 is made up of a core 18 as the shaft of the pressure roller 2, and a toner releasing heat resistant rubber layer 19 formed around the peripheral surface of the core 18, of silicon rubber or the like.

The fixing apparatus 120 is provided with a central temperature detecting apparatus 20 as a temperature detecting means for detecting the temperature level of the lengthwise center portion of the fixation roller 4 which remains within the recording medium path regardless of the recording medium size. The central temperature detecting apparatus 20 is disposed in contact with the peripheral surface of the fixation roller 4, being pressed upon the peripheral surface of the fixation roller, with the application of a predetermined amount of pressure. It is positioned so that it opposes the excitation coil 6, with the presence of the wall of the fixation roller 4 between the central temperature detecting apparatus 20 and the excitation coil 6. It is made up of a thermistor or the like. The surface temperature of the lengthwise center portion of the fixation roller 4 is detected by the thermistor, and a signal indicating the surface temperature level detected by the thermistor is sent to the CPU 12 as the controlling means, which controls the amount by which electric power is supplied to the excitation coil 6, so that the temperature of the fixation roller 4 reaches, and remains at, a preset target temperature level.

Above the fixation roller 4, a thermostat 21 as a safety mechanism for preventing the temperature of the fixation roller 4 from abnormally increasing is disposed. The thermostat 21 is kept in contact with the peripheral surface of the fixation roller 4. As the temperature of the fixation roller 4 reaches a preset temperature level, the thermostat 21 opens, mechanically interrupting the supply of electric power to the excitation coil 6, so that the temperature of the fixation roller 4 is prevented from rising above the preset temperature level. In this embodiment, a sheet of recording medium is conveyed through the image forming apparatus so that the center of the sheet of recording medium coincides with the centers of the various devices within the image forming apparatus, in terms of the direction perpendicular to the recording medium conveyance direction. In other words, when a sheet of recording medium is conveyed through the fixing apparatus, the center of the sheet of recording medium, in terms of the direction perpendicular to the recording medium conveyance direction, coincides with the lengthwise center of the fixation roller 4, regardless of the size of the sheet of recording medium. Incidentally, a sheet of recording medium of the largest size, in terms of the direction perpendicular to the recording medium conveyance direction (which hereinafter may be referred to simply as width size), which can be conveyed through the image forming apparatus (fixing apparatus) in this embodiment is a sheet of recording medium of size A4 (provided that sheet of size A4 is conveyed so that its long edges become perpendicular to recording medium conveyance direction).

Further, the fixing apparatus 120 in this embodiment is provided with a magnetic flux blocking plate 301 (which hereinafter will be referred to simply as blocking plate) as a magnetic flux controlling means which is moved into, or out of, the gap between the excitation coil 6, and the heatable portion of the fixation roller 4, in order to partially block the magnetic flux generated by the excitation coil 6, that is, in order to block the portions of the magnetic flux, which correspond in position to specific portions of the fixation roller 4 to control the specific portions in temperature. In other words, the blocking plate 301 is provided to control the amount by which heat is generated in the predetermined portions of the fixation roller 4. More specifically, the fixing apparatus 120 is structured so that the blocking plate 301 can be rotationally moved between a position (301A in FIG. 2) in which it does not block the magnetic field and a position (301B in FIG. 2) in which it partially blocks the magnetic field. The movement of the blocking plate 301 is monitored by a blocking plate movement detection sensor 22.

Referring to FIG. 3, as for the shape of the blocking plate 301, the blocking plate 301 is shaped so that its width increases in steps from the center portion toward the lengthwise ends, with the center portion being the narrowest.

Therefore, by controlling the angle by which the blocking plate 301 is rotated from the position 301A, it is possible to change the range across which the magnetic flux is directed toward fixation roller 4 from the excitation coil 6. In other words, when the portion of the fixation roller 4 designated by a referential symbol S1 in FIG. 3 is the portion of the fixation roller 4 to be heated, the range across which the magnetic flux is blocked can be reduced so that the most outward lengthwise end portions of the fixation roller 4, which are relatively narrow, are shielded from the magnetic flux by the blocking plate 301, whereas when the portion of the fixation roller 4 designated by a referential symbol S2 in FIG. 3 is the portion of the fixation roller 4 to be heated, the fixation roller 4 can be relatively widely shielded from the magnetic flux, across the lengthwise end portions.

More specifically, when multiple sheets of recording medium of the small width (size) are continuously conveyed through the fixing apparatus 120, the blocking plate 301 is rotationally moved into the position (which corresponds to S2 in FIG. 3) in which it shields the fixation roller 4 from the magnetic flux, relatively widely across the lengthwise end portions, whereas when multiple sheets of recording medium of a medium width (size) are continuously conveyed, the blocking plate 301 is rotationally moved into the position (which corresponds to S1 in FIG. 3) in which the blocking plate 301 shields the fixation roller 4 from the magnetic flux, relatively narrowly across the lengthwise end portions. Further, when multiple sheets of recording medium of the largest width (size) are continuously conveyed, the blocking plate 301 is kept in the home position, that is, the position in which the blocking plate 301 does not block the magnetic flux.

Referring again to FIG. 3, the fixing apparatus 120 is provided with first and second thermistors 401 and 402 as temperature detection elements which are placed in contact with the peripheral surface of the fixation roller 4 to detect the temperature of the fixation roller 4, in addition to the abovementioned central temperature detecting apparatus 20 disposed so that it remains in contact with the lengthwise center of the fixation roller 4. Incidentally, these thermistors may be of the noncontact type; they may be disposed in the adjacencies of the peripheral surface of the fixation roller 4, with no contact between them and the peripheral surface of the fixation roller 4.

The central temperature detecting apparatus 20 detects the surface temperature level of the lengthwise (center) portion of the fixation roller 4, that is, the portion of the fixation roller 4 which will never be shielded from the magnetic flux by the blocking plate 301. As for the first and second thermistors 401 and 402, the first thermistor 401 is positioned to detect the surface temperature level of the portion of the fixation roller 4, which will be outside the recording medium path and near the recording medium path when copies are made using sheets of recording medium of the small size, and the second thermistor 402 is positioned to detect the portion of the fixation roller 4, which will be outside the recording medium path when copies are made using sheets of recording medium of the medium size.

The fixing apparatus 120 is structured so that the driving of the blocking plate 301 by a blocking plate driving means 14 is controlled by the CPU 12 in response to the results of the detection of the temperature of the fixation roller 4 by the central temperature detecting apparatus 20, and the first and second thermistors 401 and 402. In this embodiment, the blocking plate driving means 14 is provided with a motor and a gear train, which are for rotationally moving the blocking plate 301 in a manner to follow the internal surface of the fixation roller 4. The structure of the blocking plate driving means 14 is optional; one of the known structures may be adopted instead of the above described one.

<Operation of Fixing Apparatus>

Figures 6, 6A:
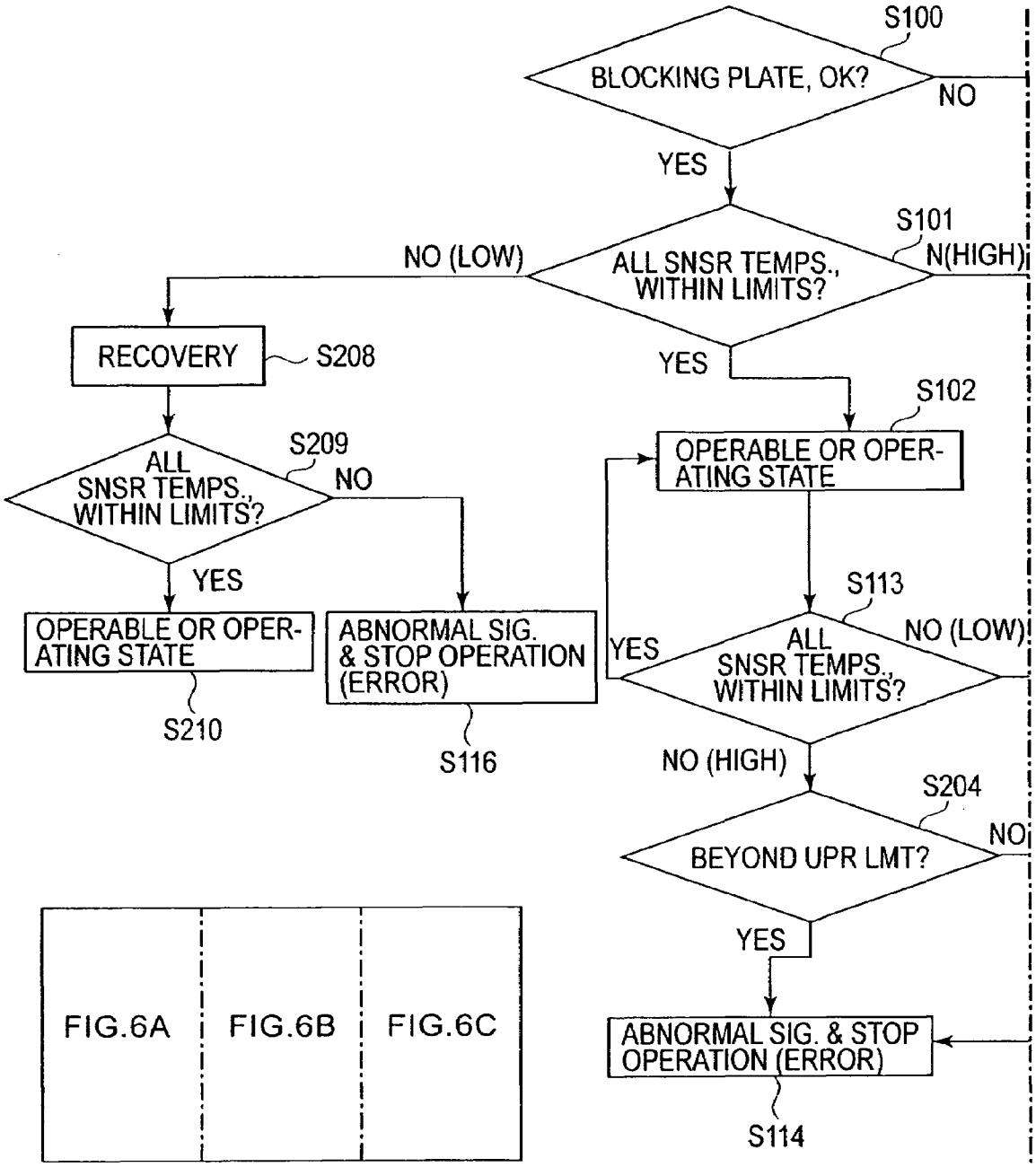
FIG. 6 is a flowchart showing the steps of the operational sequence for controlling the fixing apparatuses (image forming apparatus) in the first and second embodiments.
Figure 6B:
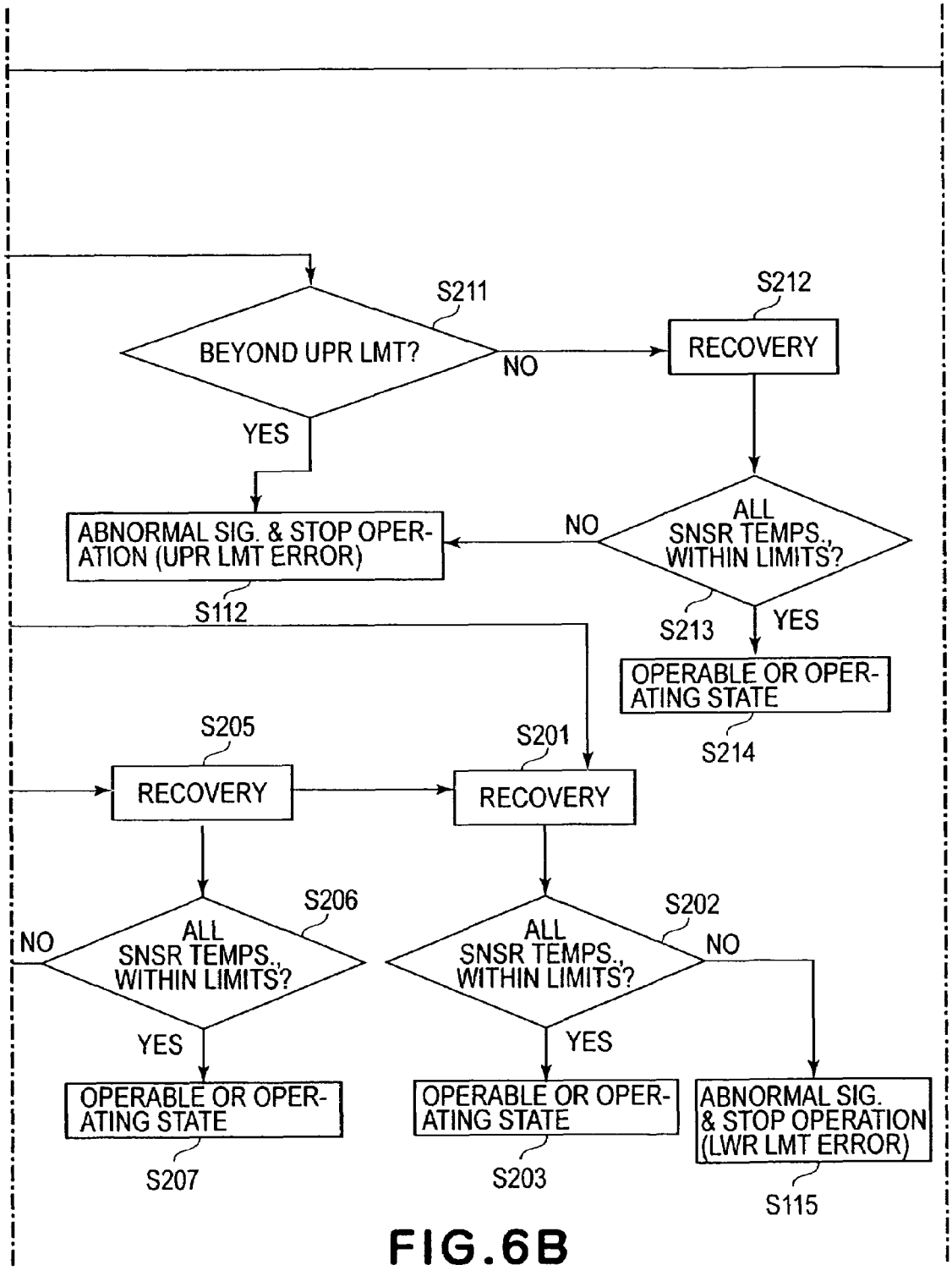
Figure 6C:
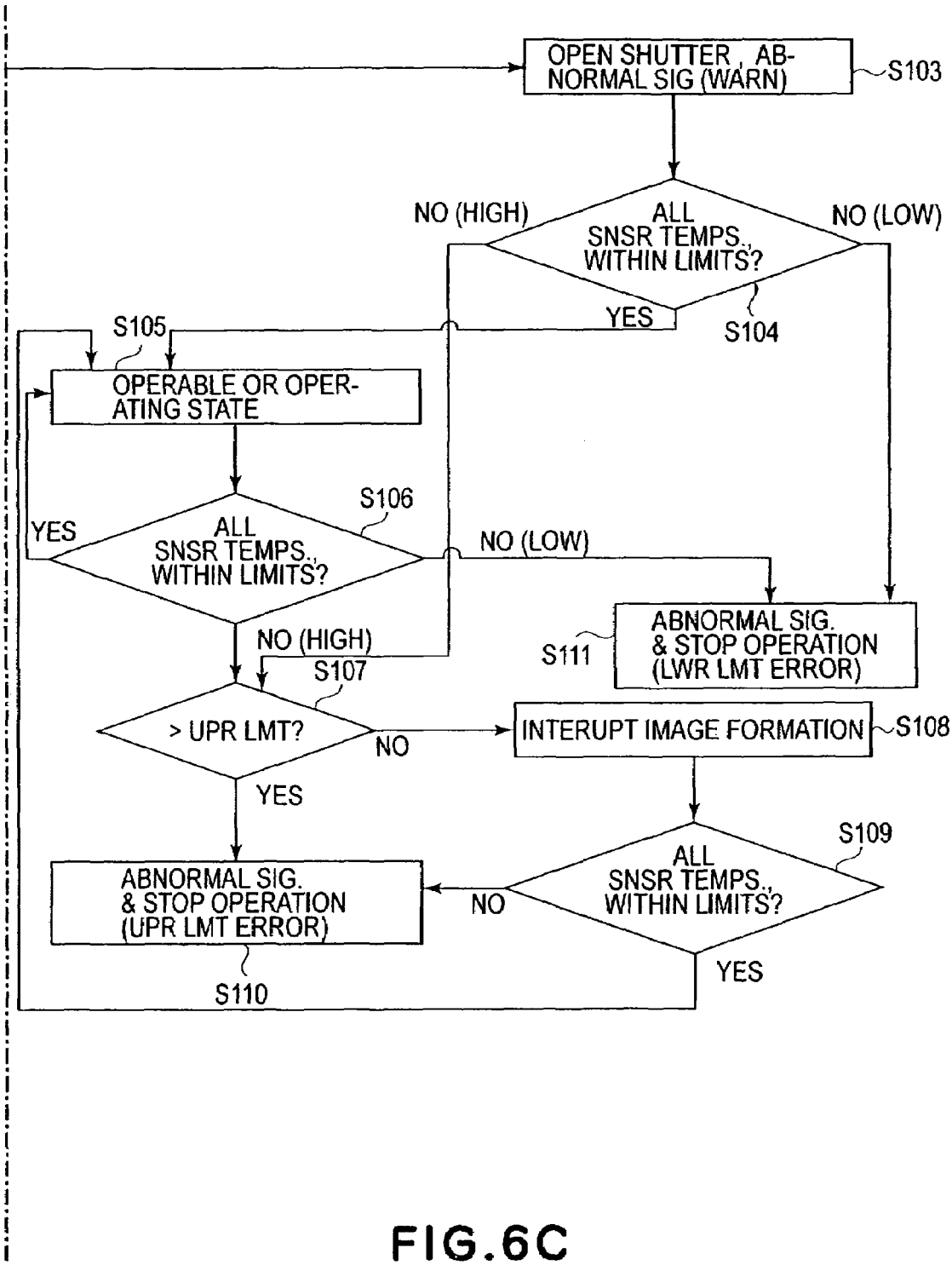

Next, referring to the appended drawings, in particular, FIGS. 2, 4, and 6, the operation of the fixing apparatus in this embodiment will be described. FIG. 4 shows the changes in the temperature of the fixation roller 4, which occurred while copies were continuously made using multiple sheets of recording medium of the small size. FIG. 6 is a flowchart showing the flow of the operational sequence of the fixing apparatus (image forming apparatus).

As described above, the temperature level of the lengthwise center portion of the fixation roller 4 is detected by the central temperature detecting apparatus 20, and the temperature of the fixation roller 4 is controlled according to the temperature level detected by the apparatus 20.

The temperature level of the lengthwise center portion of the fixation roller 4 is detected by the central temperature detecting apparatus 20, and the fixing apparatus is controlled by the CPU 12 in response to the temperature level detected by the apparatus 20. As for the temperature level of the lengthwise end portions of the fixation roller 4 (portions of fixation roller outside the path of sheet of recording medium of small size), it is detected by the thermistor located at one of the lengthwise end portions of the fixation roller 4. When sheets of recording medium of the small size are continuously conveyed through the fixing apparatus, the fixing apparatus is controlled, as follows, by the CPU 12 in response to the temperature level detected by this thermistor located at one of the lengthwise ends of the fixation roller 4. That is, the temperature of the predetermined portions of the fixation roller 4 is controlled by moving the blocking plate 301 to a specific location between the magnetic flux blocking position in which it blocks the portions of magnetic flux directed toward the predetermined portions of the fixation roller 4, and the position in which it does not block the magnetic flux, so that the temperature of the predetermined portion of the fixation roller 4 remains within a preset range.

More specifically, the highest temperature level which the coil 6 can withstand is 230° C. and the temperature level below which the low temperature offset occurs is 140° C. Therefore, the CPU 12 controls the fixing apparatus so that the temperature of the entirety of the heating range of the fixation roller 4 remains within this range (140° C.-230° C.).

In this embodiment, if the temperature level detected by the second thermistor 402 exceeds 220° C., the CPU 12 moves the blocking plate 301 into the magnetic flux blocking position for a recording sheet of the small size, with the use of the blocking plate driving means 14. If the temperature level detected by the second thermistor 402 falls below 170° C., the CPU 12 moves the blocking plate 301 into the home position, that is, the position in which the blocking plate 301 does not block the magnetic flux, with the use of the blocking plate driving means 14.

Next, referring to the flowchart in FIG. 6, the operational sequence of the fixing apparatus (image forming apparatus) will be described.

<Shutter Operation Sequence (Normal Position for Shutter)

First, as an image formation start signal is inputted, the CPU 12 monitors whether or not the operation of the blocking plate 301 is normal, with the use of a blocking plate movement detection sensor 22 (Step S100). In other words, it detects the position of the blocking plate 301.

If the CPU 12 determines that the position of the blocking plate 301 (blocking plate driving means) is normal, it determines whether or not the temperature levels detected by all the temperature detecting means (temperature sensors) are within the preset range (first referential temperature range (which is 140° C.-230° C. in this embodiment)) (Step S101).

Incidentally, the temperature levels detected by all the temperature sensors mean the temperature levels detected by the central temperature detecting apparatus 20, and the first and second thermistors 401 and 402 (which holds true throughout this specification). The bottom and top values for the first referential temperature range are optional; in other words, they may be set according to the specifications or the like of the apparatus, or may be set to specific values. Further, they may be set so that they change according to the ambient conditions or the like. In this embodiment, the bottom and top values for the first referential temperature range are changed according to whether or not the operation of the blocking plate 301 is normal (more specifically, when normal, bottom and top values are set to 140° C. and 230° C., and when abnormal, to 140° C. and 220° C.).

If it is determined in Step S101 that the temperature levels detected by all the temperature sensors are within the first referential temperature range, the CPU 12 permits the fixing apparatus (image forming apparatus) to carry out the fixing operation (image forming operation) (Step S102). That is, it puts the fixing apparatus and image forming apparatus on standby, or causes the fixing apparatus and image forming apparatus to carry out the fixing operation and image forming operation, respectively.

<Shutter Operation Sequence (When Shutter is in Abnormal Position)>

On the other hand, if the CPU determines in Step 100 that the operation of the blocking plate 301 is abnormal, it outputs the signal which indicates the presence of anomaly in the operation of the blocking plate 301, and moves the blocking plate 301 into the position in which the blocking plate 301 does not block the magnetic field formed between the excitation coil 6 and the internal surface of the fixation roller 4 (Step S103).

Further, the CPU 12, which also functions as an information disseminating means, informs a user of the presence of anomaly. As for the means for informing a user of the fixing apparatus (image forming apparatus) condition, a message is displayed on a liquid crystal display portion. Incidentally, the method for informing a user of the apparatus condition may be a warning light or sound, instead of display the warning message on a liquid crystal display.

Thereafter, the CPU 12 determines whether or not the temperature levels detected by all the temperature sensors are within the first referential temperature range (140° C.-220° C.) (Step S104). If it determines in Step S104 that the temperature levels are within the first referential temperature range, the CPU 12 permits the fixing apparatus (image forming apparatus) to carry out the fixing operation (image forming operation) (Step S105).

In this case, however, it cannot be expected that if multiple sheets of recording medium of the small size, such as size A4R, are continuously conveyed, the blocking plate 301 prevents the portions (lengthwise end portions) of the fixation roller 4 outside the recording medium path from increasing in temperature.

Thus, the CPU 12 monitors whether or not at least one of the temperature levels detected by the temperature sensors falls outside of the first referential temperature range (140° C.-220° C.)(Step S106). If even one of the temperature levels detected by the temperature sensors falls outside of the first referential temperature range, for example, if the temperature of the portion of the fixation roller 4 outside the recording medium path exceeds the highest value of the first referential temperature range, the CPU 12 determines whether or not the temperature level detected by one of the temperature sensors having exceeded the highest value of the first referential temperature range is above the highest temperature level which the fixing apparatus (coil 6) can withstand (which in this step is 230° C.) (Step S107). As for the temperature level at which the blocking plate 301 is moved into the magnetic flux blocking position when the fixing apparatus is in the normal condition, it is set to 220° C. If the CPU determines in Step S104 that at least one among the temperature levels detected by the temperature sensors is higher than the first referential temperature range, it determines whether or not the detected temperature level having exceed the first referential temperature range has exceeded the temperature limit above which the fixing apparatus (coil 6) will be damage (Step S107).

If the CPU 12 determines in Step S107 that the temperature level detected by one of the temperature sensors and having exceeded the first referential temperature range is below the abovementioned upper limit for the fixing apparatus (coil 6), it temporarily interrupts the on-going image formation job (fixing operation) to allow the temperature levels detected by all the temperature sensors to fall below 200° C. (Step S108).

During the temporary interruption of the image formation job, the CPU 12 controls the amount by which electric power is supplied to the excitation coil 6 so that the temperature level detected by the central temperature detecting apparatus 20 becomes 190° C.

Thereafter, the CPU 12 determines whether or not the temperature levels detected by all the temperature sensors are within the predetermined temperature range (Step S109). More specifically, the CPU 12 determines whether or not the temperature levels detected by the temperature sensors fall below 200° C. before the length of the temporary interruption of the on-going image forming job exceeds a preset value.

If the temperature levels detected by all the temperature sensors fall below 200° C., the CPU 12 restarts the interrupted image formation job (Step S105).

On the other hand, if the CPU 12 determines in Step S107 that one or more of the temperature levels detected by the temperature sensors remain, for a predetermined length of time, above 230° C., which is the upper temperature limit preset in consideration of the heat resistance of the coil, the CPU issues a signal indicating the presence of anomaly, and temporarily interrupts the on-going image formation job (image fixation), preventing thereby the image formation job (image fixation) from being continued (Step S110).

If the CPU 12 determines in Step S109 that the temperature levels detected by all the temperature sensors have not fallen to 200° C. even after the elapse of the length of time preset for the temporary interruption, it also outputs the signal indicating the presence of anomaly, and temporarily interrupts the on-going image formation job (image fixation), preventing thereby the image formation job (image fixation) from being continued (Step S110).

Further, if the CPU determines in Step S104 or S106 that even one of the temperature levels detected by the temperature sensors has fallen below 140° C., which is the lowest value of the first referential temperature range, it immediately outputs the signal indicating the presence of anomaly, and temporarily interrupts the on-going image formation job (image fixation), preventing thereby the image formation job (image fixation) from being continued (Step S111). In this case, it is possible to surmise that because something is wrong with the fixing apparatus, the blocking plate 301 has unexpectedly stuck in the position in which it partially blocks the magnetic field.

FIG. 4 shows the changes in the temperatures of the lengthwise center and end portions of the fixation roller 4, which occur when multiple copies are formed using multiple sheets of recording medium of the small size (A4R), the solid line represents the changes in the temperature level of the lengthwise center portion of the fixation roller 4 (temperature level detected by central temperature detecting apparatus 20), and the dotted line represents the changes in the temperature level of the lengthwise end portions of the fixation roller 4 (temperature level detected by second thermistor 402).

<Recovery Mode>

Next, referring to FIGS. 5 and 6, the recovery mode in accordance with the present invention will be described. Here, the recovery mode means the control mode (which may sometimes be referred to as recovery sequence or recovery operation) in which the apparatus begins to be operated as the temperature of the fixation roller 4 falls out of the preset temperature range. It interrupts the on-going image forming operation, and controls the fixing apparatus so that the temperature of the fixation roller 4 falls back into the preset proper temperature range.

Figure 5:
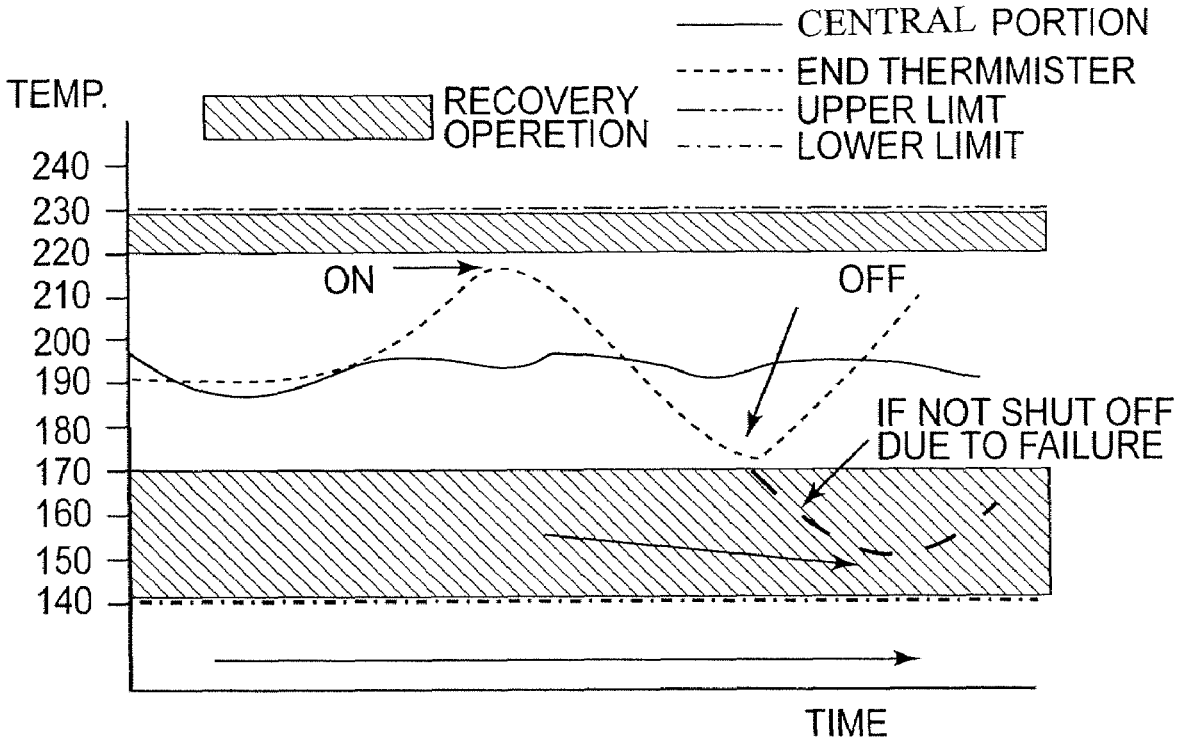
FIG. 5 is a graph showing the changes in the temperatures of the fixation roller, which occurred as sheets of recording medium, the sizes of which were smaller than that of the largest sheet of recording medium usable with the image forming apparatus (fixing apparatus), were conveyed through the fixing apparatus.

FIG. 5 is a graph showing the changes in the temperature of the fixation roller 4, which occurred when multiple sheets of recording medium of the small size were continuously conveyed through the fixing apparatus in this embodiment. FIG. 6 is a flowchart showing the flow of the operational sequence of the fixing apparatus in the recovery mode in this embodiment.

In this embodiment, a second referential temperature range is set, which is included in the first referential temperature range. The bottom and top values for the second referential temperature range are optional; they may be set according to the specifications or the like of the apparatus. They may be set to fixed values, or may be set to values which vary in response to the ambient conditions or the like.

Also in this embodiment, if the temperature levels detected by at least one of the first and second thermistors 401 and 402 falls out of the second referential temperature range, the operational mode of this image forming apparatus is switched to the recovery mode, under predetermined conditions, regardless of the position of the blocking plate 301. In other words, the operational mode of the apparatus is switched to the operational mode (recovery mode), which corresponds to the slanted broken line in FIG. 5, and in which the apparatus is operated.

When the image forming apparatus (fixing apparatus) is in the recovery mode, the following operational sequence is carried out. That is, as the temperature levels detected by at least one of the first and second thermistors 401 and 402 falls out of the second referential temperature range, the on-going image forming operation is interrupted, and the driving operation for retracting the blocking plate 301 into the position in which the blocking plate 301 does not block the magnetic field is carried out. Then, the following process for restoring the temperature of the fixation roller back into the proper range is carried out. That is, the image forming apparatus is kept on standby until the surface temperature levels of the fixation roller 4 detected by all the temperature sensors fall back into the predetermined temperature range, while controlling the amount by which electric power is supplied to the induction coil 6 so that the temperature level detected by the central temperature detecting apparatus 20 will fall back into the optimal temperature range. This is the recovery operation in this embodiment.

The recovery mode is carried out when, for example, the clearance between the coil assembly 10 and fixation roller 4 has become insufficient for the satisfactory movement of the blocking plate 301, due to the thermal expansion or deformation of the coil assembly 10 and/or fixation roller 4, which is attributable to the temperature increase outside the recording medium path. It is expected that in such a case, by switching the operational mode of the apparatus to this recovery mode, the temperature increase outside the recording medium path is reduced enough to allow the blocking plate 301 to be moved in the normal fashion.

Also in this embodiment, for the following reason, the recovery sequence is designed so that when restarting the image forming (fixing) job having been interrupted as described, the blocking plate 301 is retracted into the home position, that is, the position in which the blocking plate 301 does not block the magnetic flux, before the interrupted job is restarted.

That is, if a control is executed to set the position of the blocking plate 301 according to the temperature level of the lengthwise end portion of the fixation roller 4 detected immediately before the recovery mode is started, it is possible that the interrupted image forming (fixing) job will be restarted with the blocking plate 301 remaining in the magnetic flux blocking position. In such a case, the lengthwise end portions of the fixation roller 4 remain shielded from the magnetic flux by the blocking plate 301. Therefore, if the interrupted image forming job, which happened to be using sheets of recording medium of size A4 or A3, which are relatively long, is restarted while the image forming apparatus is in this condition, the lengthwise end portions of the fixation roller 4 rapidly decrease in temperature, resulting in the unsatisfactory image fixation; the low temperature offset occurs while the trailing end portion of the sheet of recording medium, in terms of the recording medium conveyance direction, is being conveyed through the fixating apparatus.

Thus, the fixing apparatus (image forming apparatus) in this embodiment is controlled by the CPU 12 so that the apparatus carries out the following operational sequence.

As multiple sheets of recording medium of the small size, for example, size A4, are continuously conveyed through the fixing apparatus, the portions of the fixation roller 4 outside the recording medium path excessively increase in temperature. Normally, as the portions of the fixation roller 4 outside the recording medium path excessively increase in temperature, the blocking plate 301 is to be moved into the magnetic flux blocking position. However, if the on-going image forming (fixing) job is interrupted, the blocking plate 301 is moved into the position in which it does not block the magnetic flux, even if the temperature of the portions of the fixation roller outside the recording medium path is at a level at which the blocking plate 301 is to be moved into the magnetic flux blocking position.

Then, as the image forming apparatus is permitted to start an image forming job, the job is restarted with the blocking plate 301 being kept in the nonblocking position. It is possible that the interrupted job, in which multiple sheets of recording medium of the small size had been used, will be restarted after the interruption. Also in such a case, the interrupted job is restarted with the blocking plate 301 being kept in the nonblocking position. Therefore, as the portions of the fixation roller outside the recording medium path become excessive in temperature with the progression of the image formation job, the operation for driving the blocking plate 301 is restarted.

Next, referring to the flowchart in FIG. 6, the operational sequence of the fixing apparatus (image forming apparatus) in this embodiment will be described.

In this embodiment, after it is determined that the blocking plate 301 is normal in operation (Step S100), the CPU 12 determines whether or not the temperature levels detected by all the temperature sensors are in the second referential temperature range (Step S101). Even if it is only one among the temperature levels detected by the temperature sensors that has increased to a level above the second referential temperature range, the CPU 12 determines whether or not the one having exceeded the second referential temperature range is higher than the upper limit (which in this embodiment is 230° C. (Step S211). If it is no higher than the upper limit, the CPU 12 switches the operational mode of the apparatus to the recovery mode (it causes apparatus to carry out recovery mode (Step S212). Further, the CPU 12 also switches the operational mode of the apparatus to the recovery mode (it causes apparatus to carry out recovery mode), if it is determined in Step S101 that even one of the temperature levels detected by the temperature sensors is lower than the second referential temperature range (Step S208).

As soon as the temperature levels detected by the temperature sensors fall back into the second referential temperature range due to the execution of the above described recovery operation, the CPU 12 permits the fixing apparatus (image forming apparatus) to carry out the image fixing (forming) operation (Steps S213, S214, S209, and S210). In other words, the CPU puts the fixing apparatus and image forming apparatus on standby, or causes them to carry out the image fixing operation and image forming operation, respectively.

However, if the temperature levels detected by the temperature sensors do not fall back into the second referential temperature range even after the elapse of the preset length of time, the CPU outputs the signal indicating the presence of anomaly, and interrupts the image forming (fixing) operation, preventing the image forming apparatus from continuing the image forming (fixing) operation (Steps S112 and S116).

If the temperature level detected by the first or second thermistor 401 or 402 falls out of the preset temperature range, a control similar to the above described one is initiated even during an image forming operation.

That is, when it is determined in Step S113 that at least one of the above described temperature levels have exceeded the second referential temperature range, the CPU 12 determines whether or not the temperature level having exceeded the second referential temperature range is above the upper limit (which in this embodiment is 230° C.) (Step S204). When the temperature level is no higher than the upper limit, the CPU 12 switches the operational mode of the apparatus to the recovery mode, and causes the apparatus to operate in the recovery mode (Step S205). When it is determined in Step S113 that at least one of the abovementioned temperature levels is lower than the second referential temperature range, the CPU 12 also switches the operation mode of the apparatus to the recovery mode, and causes the apparatus to operate in the recovery mode (Step S201).

As soon as the temperature levels detected by the temperature sensors fall back into the second referential temperature range due to the execution of the above described recovery operation, the CPU 12 permits the fixing apparatus (image forming apparatus) to carry out the image fixing (forming) operation (Steps S206, S207, S202, and S203). In other words, the CPU puts the fixing apparatus and image forming apparatus on standby, or causes them to carry out the image fixing operation and image forming operation, respectively.

However, if the temperature levels detected by the temperature sensors do not fall back into the second referential temperature range even after the elapse of the preset length of time, the CPU outputs the signal indicating the presence of anomaly, and interrupts the image forming (fixing) operation, preventing the image forming apparatus from continuing the image forming (fixing) operation (Steps S114 and S115).

FIG. 5 is a graph showing the changes in the temperature of the lengthwise center and end portions of the fixation roller 4, which occurred when multiple sheets of recording medium of the small size were continuously conveyed through the fixing apparatus. In the graph, the solid line represents the changes in the temperature level of the lengthwise center portion of the fixation roller 4 (temperature level detected by central temperature detecting apparatus 20), and the dotted line represents the changes in the temperature level of the lengthwise end portions of the fixation roller 4 (temperature level detected by second thermistor 402).

In this embodiment, the highest temperature level which the coil 6 can withstand is 230° C. and the temperature level below which the low temperature offset occurs is 140° C. Therefore, the CPU 12 controls the fixing apparatus so that the temperature of the entirety of the heating range of the fixation roller 4 falls within this range (140° C.-230° C.). In this embodiment, if the temperature level detected by the second thermistor 402 exceeds 220° C., the CPU 12 moves, with the use of the blocking plate driving means 14, the blocking plate 301 into the magnetic flux blocking position in which the blocking plate 301 blocks the magnetic field formed between the excitation coil 6 and the internal surface of the fixation roller 4, across the portions which correspond in position to the lengthwise end portions of the fixation roller 4. If the temperature level detected by the second thermistor 402 falls below 170° C., the CPU 12 moves, with the use of the blocking plate driving means 14, the blocking plate 301 into the home position, that is, the position in which the blocking plate 301 does not block the magnetic flux formed between the excitation coil 6 and the internal surface of the fixation roller 4.

Also in this embodiment, if the condition of the fixation roller 4 is not improved in terms of temperature, that is, the temperature levels detected by the temperature sensors remains no lower than 220° C., or no higher than 170° C., even after the elapse of the preset length of time, the CPU interrupts the image forming (fixing) operation, and causes the image forming apparatus (fixing apparatus) to start the recovery operation.

If the temperature levels detected by the temperature sensors do not fall back into the second referential temperature range even after the recovery operation is carried out for the preset length of time, for example, 30 seconds, the CPU 12 outputs the signal indicating the presence of anomaly, and interrupts the image forming (fixing) operation, preventing thereby the image forming (fixing) apparatus from continuing the image forming operation.

Incidentally, the recovery operation for an image forming (fixing) apparatus does not need to be limited to the one in this embodiment described above. In other words, all that is required of the recovery operation is that even if the temperature of the fixation roller fall out of a preset temperature range, the image forming operation is not immediately interrupted, and the image forming (fixing) apparatus is operated so that the temperature of the fixation roller falls back into the preset range.

Further, during the recovery operation, if the temperature of the fixation roller does not fall back into the preset range, in spite of the elapse of the preset length of time after the interruption of the image forming operation, the blocking plate driving means may be operated so that the blocking plate will be moved twice or more times into the nonblocking position.

As described above, according to the present invention, it is possible to improve a fixing apparatus (image forming apparatus) in heating performance, and also, to improve an image forming apparatus in usability, and the level of quality at which an image is formed by the image forming apparatus.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 308792/2004 filed Oct. 22, 2004, which is hereby incorporated by reference.

What is claimed is:

1. An image forming apparatus comprising:

image forming means for forming an image on a recording material;

a heating rotatable member for heating an image on the recording material;

magnetic flux generating means for generating a magnetic flux for induction heat generation in said heating rotatable member;

control means for controlling a temperature of said heating rotatable member;

a temperature detecting member for detecting a temperature of said heating rotatable member at a predetermined region;

magnetic flux confining means for confining the magnetic flux directed toward the predetermined region of said heating rotatable member from said magnetic flux generating means in accordance with an output of said temperature detecting means;

moving means for movement said magnetic flux confining means between a magnetic flux confinement position and a non magnetic flux confinement position;

interrupting means for interrupting a currently executing image formation job, when a detected temperature of said heating rotatable member is lower than a predetermined temperature; and reset control means for effecting, during a job of interrupting the currently executing image formation, an operation of moving said magnetic flux confining means toward the non magnetic flux confinement position and an operation of recovering a temperature of said heating rotatable member.

2. An apparatus according to claim 1, wherein the temperature restoring operation for said heating rotatable member is executed while keeping said magnetic flux confining means at the non-magnetic-flux-confinement position, irrespective of a nature of the interrupted image forming operation.

3. An apparatus according to claim 1, wherein the image forming operation is resumed while keeping said magnetic flux confining means at the non-magnetic-flux-confinement position.

4. An apparatus according to claim 1, further comprising a temperature detecting element for detecting a temperature of a region of said heating rotatable member which is widthwisely inside the predetermined region, and the temperature restoring operation for said heating rotatable member is executed by controlling electric power supply to said magnetic flux generating means in accordance with an output of said temperature detecting element.

5. An apparatus according to claim 1, further comprising notification means for notifying an abnormality when the output of said temperature detecting element indicates a temperature outside a predetermined temperature range.

6. An apparatus according to claim 5, wherein said notification means has a display portion for notifying the abnormality.

* * * * *

UNITED STATES PATENT AND TRADEMARK OFFICE

CERTIFICATE OF CORRECTION

PATENT NO. : 7,251,428 B2
APPLICATION NO. : 11/254799
DATED : July 31, 2007
INVENTOR(S) : Yasuhiro Yoshimura et al.

It is certified that error appears in the above-identified patent and that said Letters Patent is hereby corrected as shown below:

ON THE TITLE PAGE:
At Item (57), Abstract, Line 7, "confinor" should read --confiner--.
At Item (57), Abstract, Line 10, "movement" should read --moving--.
At Item (57), Abstract, Line 17, "restoring" should read --restores--.
At Item (57), Abstract, Line 12, "an on-magnetic-flux-confinement" should read --a non-magnetic-flux-confinement--.
At Item (57), Abstract, Line 16, "confinor" should read --confiner--.

IN THE DRAWINGS:
Sheet No. 3, Figure 4, "CENTERAL" should read --CENTRAL--, and "THERMMISTER" should read --THERMISTOR--.

Sheet No. 4, Figure 5, "OPERETION" should read --OPERATION--, and "THERMMISTER" should read --THERMISTOR--.

COLUMN 1:
Line 44, "above described" should read --above-described--.
Line 64, "above" should read --above---.

COLUMN 2:
Line 5, "above described" should read --above-described--.
Line 16, "above described" should read --above-described--.
Line 20, "movement" should read --moving--.

COLUMN 8:
Line 24, "above described" should read --above-described--.

COLUMN 10:
Line 3, "display" should read --displaying--.
Line 39, "exceed" should read --exceeded--.
Line 41, "damage" should read --damaged--.

COLUMN 11:
Line 1, "remain," should read --remains--.
Line 2, "time," should read --time--.
Line 31, "(Ar), the" should read --(A4). The--.

UNITED STATES PATENT AND TRADEMARK OFFICE

CERTIFICATE OF CORRECTION

PATENT NO. : 7,251,428 B2
APPLICATION NO. : 11/254799
DATED : July 31, 2007
INVENTOR(S) : Yasuhiro Yoshimura et al.

It is certified that error appears in the above-identified patent and that said Letters Patent is hereby corrected as shown below:

COLUMN 13:
Line 40, "230°C." should read --230°C.)--.
Line 43, "mode" should read --mode)--.
Line 52, "above described" should read --above-described--.

COLUMN 14:
Line 3, "above described" should read --above-described--.
Line 6, "above described" should read --above-described--, and "have" should read --has--.
Line 22, "above described" should read --above-described--.

COLUMN 15:
Line 7, "remains" should read --remain--.

COLUMN 16:
Line 15, "movement" should read --moving--.
Line 17, "non magnetic" should read --non-magnetic--.
Line 26, "non magnetic" should read --non-magnetic--.

Signed and Sealed this

Sixth Day of May, 2008

JON W. DUDAS
*Director of the United States Patent and Trademark Office*